US008876661B2

(12) United States Patent
Lu

(10) Patent No.: US 8,876,661 B2
(45) Date of Patent: Nov. 4, 2014

(54) MULTI-FUNCTIONAL MOTIVATING EXERCISE EQUIPMENT

(76) Inventor: Zhenyu Lu, Boise, ID (US)

( * ) Notice: Subject to any disclaimer, the term of this patent is extended or adjusted under 35 U.S.C. 154(b) by 61 days.

(21) Appl. No.: 12/748,389

(22) Filed: Mar. 27, 2010

(65) Prior Publication Data

US 2011/0237396 A1 Sep. 29, 2011

(51) Int. Cl.
*A63B 24/00* (2006.01)

(52) U.S. Cl.
USPC ..... 482/1; 482/51; 482/54; 482/904

(58) Field of Classification Search
USPC ..... 482/51–54, 148, 904, 908
See application file for complete search history.

(56) References Cited

U.S. PATENT DOCUMENTS

| | | | | |
|---|---|---|---|---|
| 5,085,427 | A * | 2/1992 | Finn | 482/148 |
| 5,257,701 | A * | 11/1993 | Edelson | 211/149 |
| 5,813,947 | A * | 9/1998 | Densmore | 482/51 |
| 6,389,992 | B1 * | 5/2002 | Miller | 108/102 |
| 6,808,475 | B2 * | 10/2004 | Kehrbaum | 482/54 |
| 7,335,147 | B2 * | 2/2008 | Jones et al. | 482/148 |
| 7,445,583 | B2 * | 11/2008 | Chen | 482/57 |
| D601,644 | S * | 10/2009 | Kim | D21/696 |
| 7,614,991 | B2 * | 11/2009 | Fox | 483/54 |
| 7,686,742 | B2 * | 3/2010 | Tischler et al. | 482/57 |
| 7,811,200 | B2 * | 10/2010 | Chiang | 482/1 |
| 7,887,021 | B2 * | 2/2011 | Shevin-Sandy | 248/447.1 |
| 7,892,148 | B1 * | 2/2011 | Stauffer et al. | 482/54 |
| 8,029,418 | B2 * | 10/2011 | Nishimura | 482/54 |
| 2006/0199714 | A1 * | 9/2006 | Yang | 482/148 |
| 2006/0247109 | A1 * | 11/2006 | Powell | 482/148 |
| 2006/0258513 | A1 * | 11/2006 | Routley et al. | 482/54 |
| 2007/0069101 | A1 * | 3/2007 | Shevin-Sandy | 248/441.1 |
| 2008/0096745 | A1 * | 4/2008 | Perry | 482/148 |
| 2008/0272628 | A1 * | 11/2008 | Lazar | 297/118 |
| 2011/0082014 | A1 * | 4/2011 | Leonhard | 482/57 |
| 2011/0163218 | A1 * | 7/2011 | Kelley, III | 248/441.1 |

* cited by examiner

*Primary Examiner* — Glenn Richman

(57) ABSTRACT

A multi-functional exercise machine, whose console has a transformation bearing and can be converted between a central control panel and an exercise workstation, so that the exercise machine can be used not only for intensive exercise but also for moderate exercise while working or entertaining at the same time. The exercise workstation has an arm support and a computer desk for a user to efficiently work with a personal computer free of distractions while doing exercise. The arm support is specially designed to minimize upper body movements. A supporting assembly for the console is specially designed to minimize vibration and shaking during exercise. The equipment can further comprise a force adjustable body support to decrease load by supporting predetermined amount of weight, so that a user can do exercise longer while working with a computer.

20 Claims, 6 Drawing Sheets

MULTI-FUNCTIONAL MOTIVATING EXERCISE EQUIPMENT

FIELD OF THE INVENTION

The present invention relates to an exercise equipment and, more particularly, to a multi-functional exercise equipment which has a transformable console to allow user to use a personal laptop computer while doing exercise for improving exercise motivation. The equipment can minimize vibration and shaking of the computer and upper body movements during exercise, so that user can comfortably work and enjoy entertainment without distractions.

BACKGROUND OF THE INVENTION

Exercise is a very important activity for modern people, especially for those whose work requires sitting in office for most of time daily. Exercise machines become more and more popular for families. However, what mainly hinders people from doing enough exercise is the competition from entertainment and work. People tend to put more time on work for career advancement and often occupy the time originally planned for exercise. After daily work, people usually get tired, both physically and psychologically, and need some entertainment to get psychological relaxation which can not be obtained from exercise. Once start getting entertainment, more time tends to be consumed than expected. As a result, users of exercise machines often find themselves using those machines less and less since the purchase.

Many users find exercise machines, such as treadmills, elliptical machines and stationary bicycles, monotonous and lose interest after a period. These exercise machines do not offer the psychological satisfaction which outdoor runners usually get from running in new locations away from somewhere familiar. Many outdoor runners enjoy the natural beauty outside and the challenges of making longer distance associated with real scenery. Such stimulation is very difficult to be obtained from common exercise machines. Therefore, many users try to watch TV or listen to music while using exercise machines. However, TV programs are not specifically designed for exercise and different contents results the strength of motivation varying from time to time. Also, the stimulation of music can not last for a long time.

An effective way to solve these issues is combination of a personal computer with an exercise machine, so that exercise can be effectively incorporated with work and flexible entertainment. Virtual reality simulations or video games can generate virtual reality environment and apply exercise movement data to create interactive entertainment, therefore, help to gain both physical exercise and psychological relaxation at the same time. People can also effectively use their time by doing work with personal computers while doing exercise. Therefore, great amount of motivation and benefits can be created with the computer and exercise machine combination.

U.S. Pat. No. 2007/0287597 A1 issued to Cameron discloses a multi-purpose exercise equipment which is able to access internet and do work via a computer system while doing exercise. The exercise equipment is a combination of a computer and a stationary bicycle. However, such system will be much more expensive than a common stationary bicycle. The computer system on the exercise equipment could also be used by many other people, especially in a gym, so it can not be as convenient as a personal computer to maintain exercise data, personal files and do personal work. Moreover, the invention is limited on only stationary bicycles. Many people may prefer other types of exercise machines, such as treadmills and elliptical equipments.

U.S. Pat. No. 2008/0096745 A1 issued to Perry describes a combination office and exercise work station having a desk component, an exercise component and a torso support. This invention provides a solution for working and exercising at the same time. U.S. Pat. No. 5,257,701 issued to Edelson describes a collapsible desk with unique height adjustment features which allow user to change positions and exercise while working. However, the exercise equipment with a desk configuration is more of office equipment than sport equipment. This kind of equipments can not efficiently solve the distraction issue caused by upper body movements during exercise. With these equipments, only treadmill type of exercise components are acceptable and people can only do walking with them, in order to minimize body movement and maintain a fair working efficiency. They are not suitable for those who want to have an intensive exercise or want to use elliptical machines. Some people go to gyms for a motivating environment with many people doing exercise together and may prefer using a common simple console for an intensive exercise. For intensive exercise, people usually can't do complicated computer operation. For the same reason and appearance limitation, this kind of exercise machines is not suitable in gyms. After all, not all customers will bring laptops with them when go to gyms.

There are other prior arts, such as U.S. Pat. No. 7,335,147 B2 issued to Jones et al. and U.S. Pat. No. 2006/0258513 A1 issued to Routley et al., disclose laptop trays or holders that can be mounted to exercise machines and allow people to use laptop computers. However, the trays or holders are extra parts and may not able to be mounted properly for certain designs of exercise machines. Also this type of equipments relies too much on the stability of the exercise machines they are mounted to, and are generally shaky and unstable to hold laptops during exercise. There will be distractions caused by both vibration and shaking of laptop and moving of human body during exercise. As a result, it is difficult to focus on the work using laptops.

Furthermore, for standing exercise machines, people will get tired in a relatively short time, this is not ideal because working and entertainment can easily take hours. For this issue, none of prior arts can provide an effective solution.

In summary, a successful combination of a computer with an exercise machine for improving exercise motivation needs to meet multiple demands: 1) effectively work with personal exercise data, personal work and personal preferred entertainment; 2) satisfy both intensive exercise and moderate exercise. 3) suitable for both families and gyms; 4) minimize vibration and shaking of computer and upper body movements, so that user can work with the computer without distraction; 5) applicable for different types of exercise machines, such as treadmills, elliptical machines and stationery bicycles; 6) capable of decreasing loads for standing exercise machines, so that people can exercise longer with working and entertainment at the same time. The present invention will effectively cover all these features.

SUMMARY OF THE INVENTION

In accordance with the present invention, there is provided an exercise machine, whose console has a transformation bearing which has parts that can be slidden, rotated, extended, or unfolded so that the console can be transformed into an exercise workstation, comprising an arm support and a computer desk. The combination of the arm support and the computer desk is for user to efficiently work with a personal computer free of distractions while doing exercise. The user can place his arm on the arm support and type the keyboard of the computer placed on the computer desk in front of him. The height and the angle can be adjusted for both components. The console can be transformed between a shape of central control panel and the exercise workstation described above, so that it can be used for both highly focused extensive exercise and moderate exercise while working or entertaining at same time, in either family or gym environment.

The arm support is specially designed to restrict elbow movement and help to support upper body, so that the upper body is naturally stabilized and upper body movements are minimized. In another embodiment, the arm support is designed to support shoulder so that the upper body movements can be further decreased.

The computer desk can be connected to the arm support as a single piece if there is not much vibration and shaking generated by the exercise machine. However, there could be strong vibration and shaking generated by certain types of exercise machines, such as elliptical machines. The connection between the computer desk and the arm support can be cushioned or movably connected and extra uprights standing completely independent of the exercise device can be used to support the computer desk. In another embodiment, the computer desk is completely separated from the arm support, with extra uprights supporting it independently. The console support base and the exercise device can be movably connected or separated from each other so that the vibration and shaking of the exercise device will not affect the console or the exercise workstation during exercise.

With these designs described above, the vibration and shaking of computer desk and upper body movements can both be minimized during exercise. So that user can focus on working and entertaining while doing exercise at the same time.

The equipment can further comprise a body support for supporting human body while doing exercise. In a preferred embodiment, the body support is supporting force adjustable and has a base, a frame, a back cushion, a seat and an adjustable spring support. The force adjustable body support can further minimize upper body movements, as well as decrease load by supporting predetermined amount of weight. This will help to protect user's joints and allow for longer exercise while working and entertaining at the same time.

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the Figures.

DESCRIPTION OF THE PREFERRED EMBODIMENT

Figure 1:
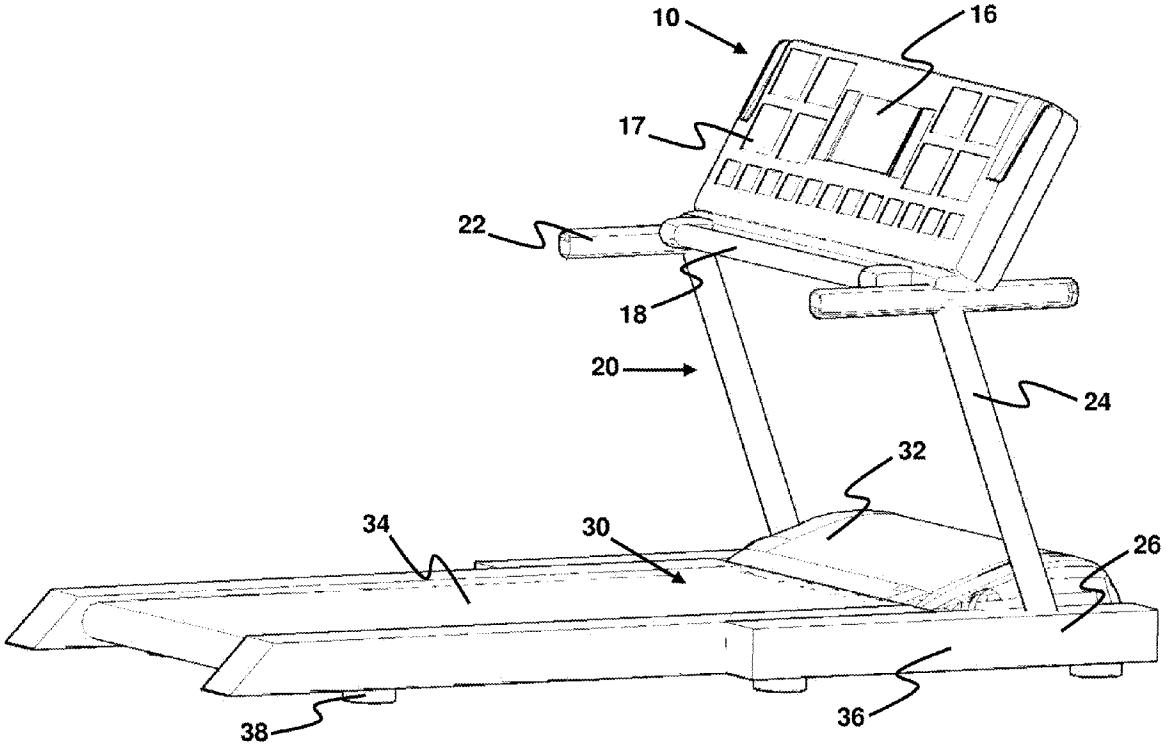
FIG. 1 is a perspective view of a treadmill with a transformable console.
Figure 2:
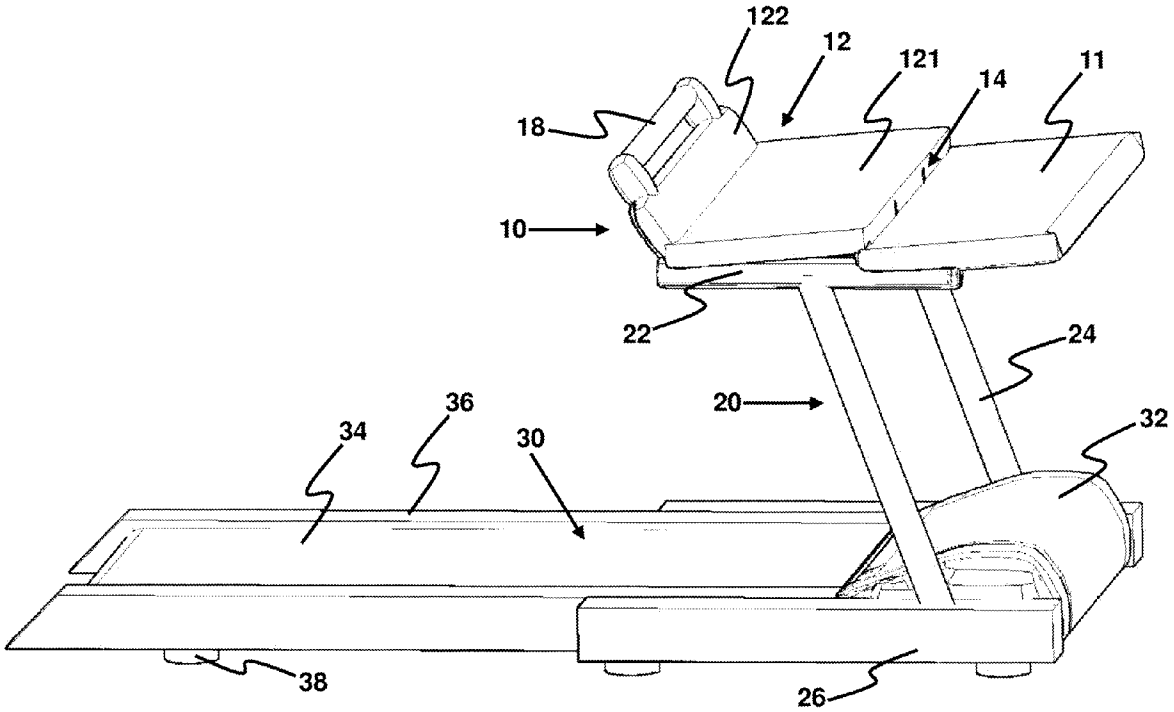
FIG. 2 is a perspective view of a treadmill with a transformable console converted to a workstation.

This invention provides a solution for improving exercise motivation by applying a transformable console 10 to an exercise machine. FIGS. 1 and 2 show perspective views of a treadmill with a transformable console 10, in its original central control panel form and converted to an exercise workstation respectively. The exercise machine has three major components as shown in FIG. 1, a transformable console 10, a console support assembly 20 and an exercise device 30. The console support assembly 20 comprises two uprights 24, a console support base 26 and two handrails 22 as the console adapter on which the transformable console 10 can be slidden and rotated. The exercise device 30 has a motor and housing assembly 32, an exercise belt 34 and two foot rails 36. Both the console support assembly 20 and the exercise device 30 have supporting feet 38 and placed on the ground. The supporting feet 38 can be replaced with rollers if needed. When the transformable console 10 is in its original form, the treadmill is just like a common treadmill with a common console which generally has display arrangements 16, operational arrangements 17 and a pulse sensor handle 18. However, after the transformable console 10 is slidden and rotated on the handrails 22 and unfolded with hinges 14, it can be converted to an exercise workstation where a user can work with a personal computer comfortably with much larger area.

The exercise workstation can simply be a computer desk 11 if there are not much upper body movements during exercise, however, in many cases upper body movements need to be controlled. In the preferred embodiment, the exercise workstation has an arm support 12 and a computer desk 11, as shown in FIG. 2. The combination of the arm support 12 and the computer desk 11 is for a user to efficiently work with a personal laptop computer free of distractions while doing exercise. The user can place his arm on the arm support 12 and type the keyboard of the laptop placed on the computer desk 11 in front of him. The height and the angle can be adjusted for both the arm support 12 and the computer desk 11. The arm support has a forearm support 121 and an upper arm support 122 to restrict elbow movement and help to support upper body, so that the upper body is naturally stabilized during exercise and upper body movements are minimized. The angle of the upper arm support 122 can be adjusted for most comfortable position. The upper arm support 122 can also be extendable to support shoulder so that the upper body movements can be further decreased.

The transformable console 10 can be converted between shapes of a central control panel and the exercise workstation described above, so that it can be used for both highly focused extensive exercise which needs operations with a common console and moderate exercise while working or entertaining at same time, in either family or gym environment.

Figure 3:
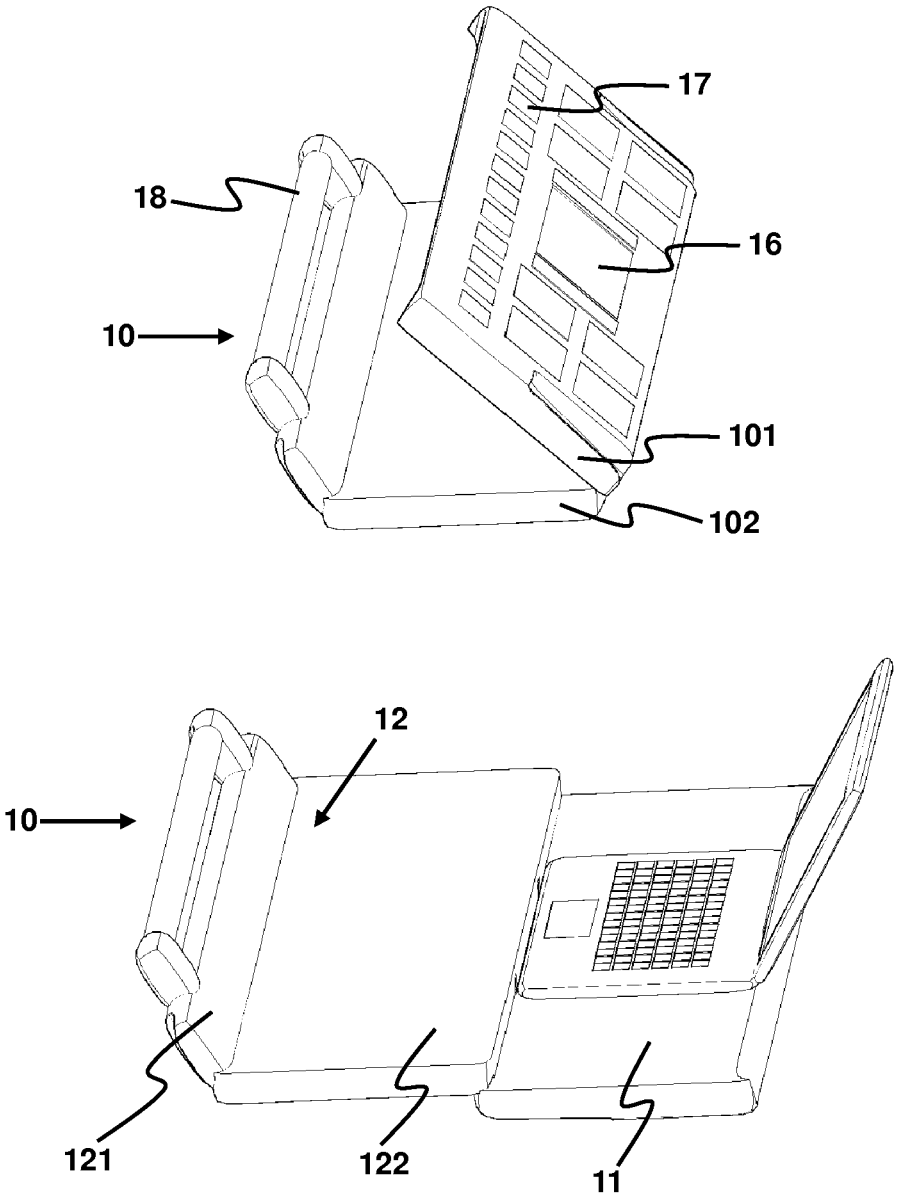
FIG. 3 is a perspective view of a transformable console showing how it can be transformed to a workstation.
Figure 4:
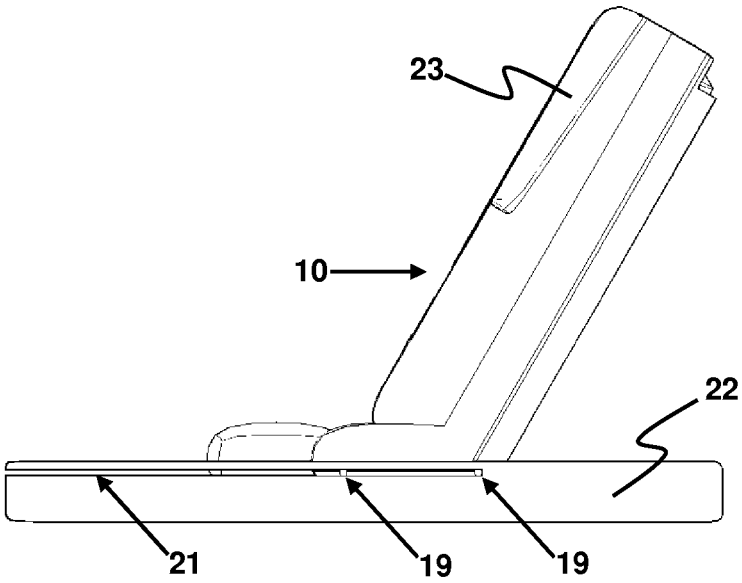
FIG. 4 is a cross-section view of a transformable console placed on handrails showing how it can be transformed to a workstation.
Figure 4:
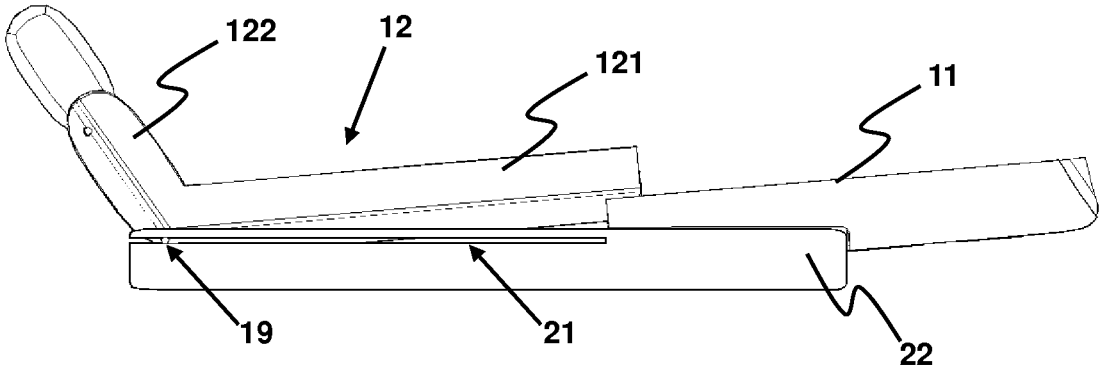

FIG. 3 shows that the transformable console 10 has a front piece 101 and a rear piece 102 that can be unfolded to convert to an exercise workstation. The front side of the front piece 101 has an appearance of a common console. The back side of the front piece 101 will become the computer desk 11 and the rear piece 102 will become the arm support 12 when fully unfolded. The height difference between the computer desk 11 and the arm support 12 can be adjustable to fit different laptop heights. The rear piece 102 has sliding rollers 19, which can slide in the sliding dents 21 of the handrails 22, as shown in FIG. 4. Started from the original common console form, the transformable console 10 can slide towards the inner end (close to a user) of the handrails 22. After the inner sliding rollers 19 are taken out of the sliding dents 21, the transformable console 10 can be rotated and fully unfolded. With the fitting dents 23 of the front piece 101 fitting in the handrails 22, the transformable console 10 is converted to its exercise workstation form. Those hinges 14, sliding rollers 19, and sliding dents 21 are transformation bearings enabling the transformation function of the transformable console 10. In order to stabilize the position for the console form and the exercise workstation form, the sliding dents 21 can be modified to lock the sliding rollers 19 at proper locations and additional locking parts can also be applied.

It is noted that the transformable console 10 is not limited to the configuration described above. For example, the transformation can be realized not only by unfolding but also by sliding, extending, bending or rotating, etc. between the two pieces and the console is not limited with two-piece-structure. Even with a single piece, if the console can be rotated and slidden, it can also be a transformable console 10 with its front side to be used as a central control panel and its back side to be used as an exercise workstation. Moreover, the transformable console can have more than two movable pieces to transform to at least one form of exercise workstation with extra features. There are extra components that should be incorporated into the design of a transformable console 10, such as accessory trays and electrical fans. When converted to an exercise workstation, these components should be at proper locations on the exercise workstation for a user to use. Electrical fans may be placed to a location of the computer desk 11 after conversion, so that when a laptop computer is placed on, the fans are under the computer and can be used to cool it. When in the exercise workstation form, it may also be convenient to have some operational buttons or all operational interface of the console that can be easily reached to have necessary control of the exercise machine when working with a laptop computer. There could be many different designs for converting a console to a work station by various methods of folding, extending, sliding, rotating or bending, etc. However, these are all based on the same idea of applying a transformable console 10.

Power cords and signal cords of the transformable console 10 should be properly arranged and positioned, so that they will not be damaged during the conversion process. There can also be a USB cable or wireless connection to connect the transformable console 10 with the laptop computer, so that the exercise machine can be controlled by the computer and exercise movement data can be transferred for interaction. Extra software, such as video games and virtual reality simulations, can be installed to realize the interaction and improve motivation of exercise. Internet is another resource for improving exercise motivation. The computer desk 11 is not limited to a shape of desk, it can have other shapes such as a rack or a tray. The computer desk 11 is not limited to support a laptop computer, it can also be used to work with a keyboard and a mouse for a desktop computer and it can also support a monitor, a flat panel computer or other electronic devices.

Figure 5:
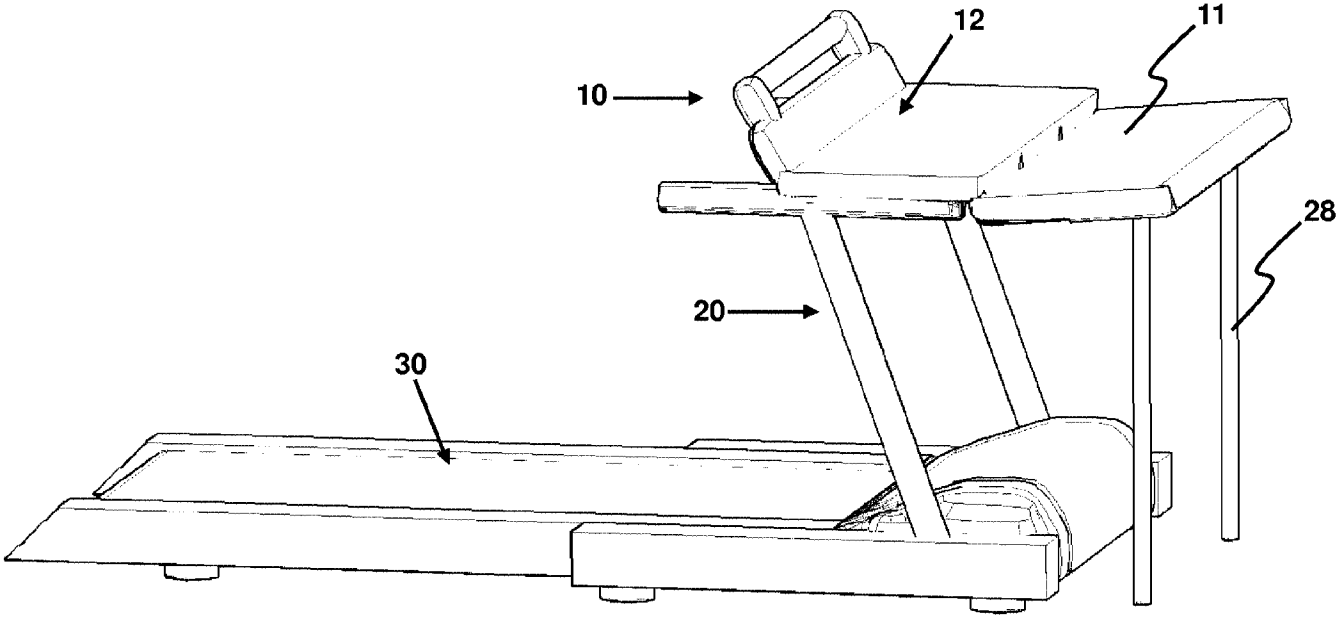
FIG. 5 is a perspective view of a treadmill with a transformable console converted to a workstation and extra uprights to support the computer desk portion.

The computer desk can be connected to the arm support 12 as a single piece if there is not much vibration and shaking generated by the exercise device 30. However, there could be a large amount of vibration and shaking generated by certain types of exercise machines, such as elliptical machines. FIG. 5 shows that extra uprights 28 standing completely independent of the exercise device 30 are applied to support the computer desk 11. The connection between the computer desk 11 and the arm support 12 can be cushioned or movably connected to decrease vibration and shaking. In an extreme case, the computer desk 11 is completely separated from the arm support 12, with extra uprights 28 supporting it independently. The console support base 26 and the exercise device 30 is preferred to be movably connected, cushioned, or separated from each other so that the vibration and shaking of the exercise device 30 will not affect the console or the exercise workstation during exercise. Moreover the exercise device can have a cushion device or a vibration absorption device to control the source of vibration and shaking.

With these designs described above, the vibration and shaking of computer desk 11 and upper body movements can both be minimized during an exercise. So that people can focus on working and entertaining while doing exercise at the same time.

Figure 6:
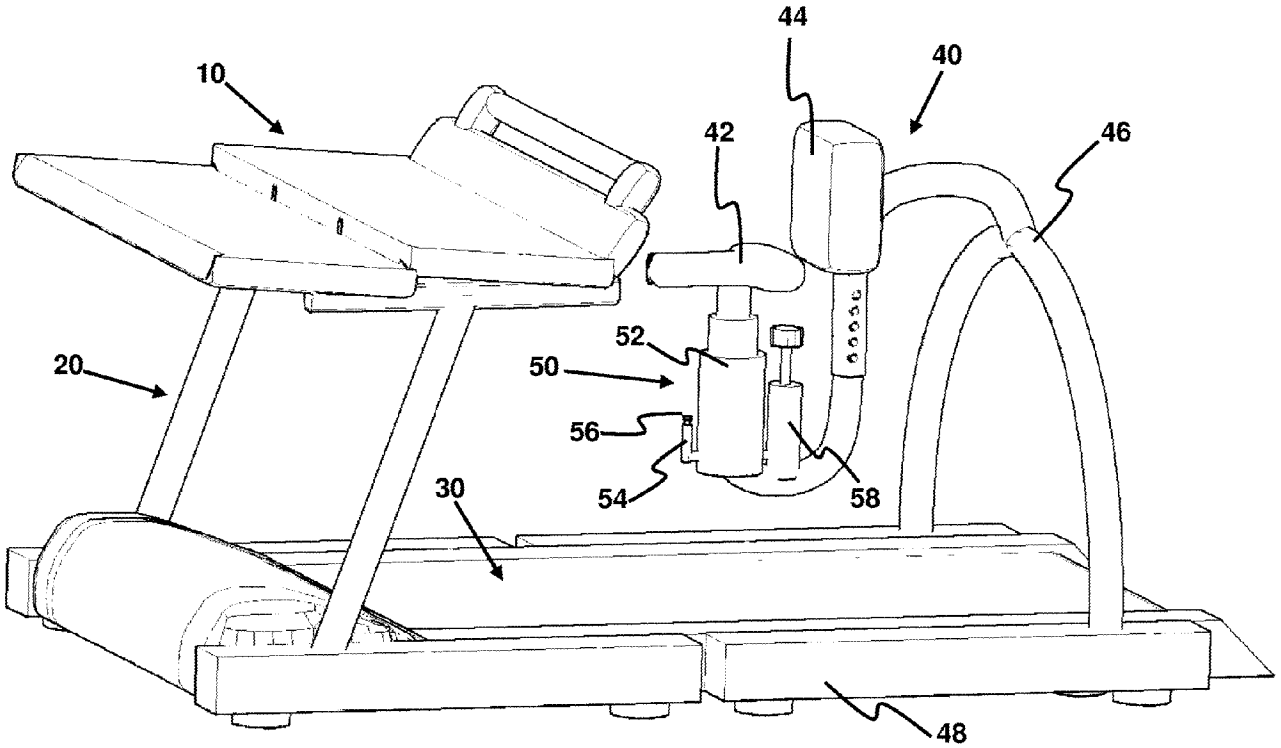
FIG. 6 is a perspective view of a treadmill with a transformable console converted to a workstation and a force adjustable body support.

As shown in FIG. 6, the equipment can further comprise a force adjustable body support 40, which has a base 48, a frame 46, a back cushion 44, a seat 42 and an adjustable spring support 50. The force adjustable body support 40 can further minimize upper body movements, as well as decrease load when using stand on an exercise machine by supporting predetermined amount of weight. This will help to protect user's joints and allow for longer exercise while working and entertaining at the same time. A seat is one way to support human body and there are other ways to achieve the same purpose as a body support. The back cushion 44 is for a user to further stabilize and get more rest for the upper body.

In the preferred embodiment, the adjustable spring support 50 comprises a pneumatic spring assembly 52, a pressure gauge 54, a pressure relief valve 56 and an air compressor 58. The pneumatic spring assembly 52 has a pneumatic spring inside of a height adjustable housing to support the seat 42. The pressure gauge 54 is for measuring the air pressure inside the pneumatic spring assembly 52. If the supporting force needs to be increased, one can use the air compressor 58 to increase the air pressure of the pneumatic spring assembly 52, so that it can support more weight. If the supporting force is too much, the pressure relief valve 56 is able to decrease the pressure of the pneumatic spring assembly 52 by releasing air. Therefore, the supporting force can be adjusted to a predetermined value before exercise. There are also other ways to achieve the supporting-force-adjustable function, such as using steel springs or using combination of weight stacks, pulleys and cables to pull the seat 42 instead. However, they should all be considered as adjustable spring supports 50.

Although only treadmills are used to illustrate the invention, all ideas described above are also applicable to other types of exercise machines with force resistive movable parts to receive force applied by users during exercise, such as elliptical machines, dual trainers and stationary bicycles, etc. Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims:

1. A transformable console for an exercise machine comprising:

a main body which is capable of being converted between at least two forms;

a transformation bearing having a pivot, a slide, or both to enable the conversion of the main body;

a central control panel which enables a user to control or interact with the exercise machine;

wherein when in the first form, the main body comprises the central control panel on an upper surface or working surface oriented for convenience of operation; wherein when in the second form, the main body comprises a shelf or frame substantially facing up and exposed to enable the user to rest a computer or other electronic devices on; and wherein when the main body in the first form, the shelf or frame is disposed through the transformation bearing to be entirely or partially covered by the central control panel.

2. The transformable console of claim 1, wherein the main body has a single piece structure with a front side having the central control panel and a back side which can be used as the shelf or frame.

3. The transformable console of claim 1, wherein the main body has a structure of at least two pieces; wherein the first piece has the central control panel; wherein the second piece has the shelf or frame.

4. The transformable console of claim 1, further comprising an electrical fan which is exposed on top of the shelf or frame when said transformable console is converted to the second form.

5. The transformable console of claim 1, wherein when in the second form, the main body further comprising an operational button or switch adjacent to the shelf or frame easily reachable by the user.

6. The transformable console of claim 1, further comprising an arm support when converted to the second form.

7. The transformable console of claim 6, wherein the arm support comprises a forearm support and an upper arm support.

8. The transformable console of claim 6, wherein the arm support and the shelf or frame are movably connected, cushioned or separated to minimize vibration and shaking during exercise.

9. The transformable console of claim 1, further comprising a signal transfer device interacting between the user's computer and the transformable console.

10. An exercise equipment which enables a user to use a computer or other electronic devices while doing exercise, comprising:

a transformable console which has a central control panel enabling the user to control or interact with the exercise equipment, a shelf or frame, and a transformation bearing having a pivot, a slide, or both; wherein the transformable console can be converted between at least two forms through the transformation bearing; wherein when in the first form, the central control panel is on an upper surface or working surface oriented for convenience of operation, and the shelf or frame is disposed to be entirely or partially covered by the central control panel; wherein when in the second form, the shelf or frame is disposed to be substantially facing up and exposed to enable the user to rest the computer or other electronic devices on;

a console support assembly which comprises a console adapter where the transformable console is coupled and an upright which is supporting said console adapter;

an exercise device having a force resistive movable part to receive force applied by the user during exercise.

11. The exercise equipment of claim 10, further comprising a body support, for supporting human body while doing exercise.

12. The exercise equipment of claim 10, further comprising a shelf support for supporting the shelf or frame.

13. The exercise equipment of claim 10, wherein the console support assembly further comprising a console support base where the upright is placed; wherein the console support base is cushioned from, movably connected to or separated from the exercise device to minimize vibration and shaking during exercise.

14. The exercise equipment of claim 10, further comprising a cushion device or a vibration absorption device to minimize vibration and shaking during exercise.

15. The exercise equipment of claim 11, wherein the body support comprises a frame, a seat and an adjustable spring support.

16. The exercise equipment of claim 11, wherein the body support comprises a seat and a back cushion.

17. The exercise equipment of claim 15, wherein the adjustable spring support comprises a pneumatic spring assembly, a pressure gauge, a pressure relief valve and an air compressor.

18. The exercise equipment of claim 15, wherein the adjustable spring support comprises a weight stack, a pulley and a cable.

19. An exercise equipment which enables a user to use a computer or other electronic devices while doing exercise, comprising:

a central control panel which enables the user to control or interact with the exercise equipment;

a transformation bearing having a pivot, a slide, or both;

a shelf or frame which is coupled to the transformation bearing;

a console support assembly which comprises a console adapter and an upright which is supporting the console adapter;

an exercise device having a force resistive movable part to receive force applied by the user during exercise;

wherein the exercise equipment can be converted between at least two forms through the transformation bearing; wherein when in the first form, the central control panel is on an upper surface or working surface oriented for convenience of operation, and the shelf or frame is disposed below the central control panel; and wherein when in the second form, the shelf or frame is disposed to be substantially facing up and exposed so that the user can place the computer or other electronic devices on the shelf or frame.

20. The exercise equipment of claim 19, further comprising a body support, for supporting human body while doing exercise.

* * * * *